US009410337B1

(12) United States Patent
Wall

(10) Patent No.: US 9,410,337 B1
(45) Date of Patent: Aug. 9, 2016

(54) SWIMMING POOL FILTER WATER RETURN FITTING

(71) Applicant: Frank L. Wall, Columbus, MS (US)

(72) Inventor: Frank L. Wall, Columbus, MS (US)

( * ) Notice: Subject to any disclaimer, the term of this patent is extended or adjusted under 35 U.S.C. 154(b) by 132 days.

(21) Appl. No.: 14/090,947

(22) Filed: Nov. 26, 2013

Related U.S. Application Data

(60) Provisional application No. 61/730,250, filed on Nov. 27, 2012.

(51) Int. Cl.
*E04H 4/00* (2006.01)
*E04H 4/12* (2006.01)

(52) U.S. Cl.
CPC ..... *E04H 4/12* (2013.01)

(58) Field of Classification Search
CPC ..... E04H 4/12; E04H 4/0075; E04H 4/148; E04G 11/12; E04G 17/0721; E04G 17/065; E04G 17/0654
USPC ..... 4/507; 249/39, 41, 90, 91; 52/426.1
See application file for complete search history.

(56) References Cited

U.S. PATENT DOCUMENTS

| | | | | |
|---|---|---|---|---|
| 3,625,470 | A * | 12/1971 | Shoemaker | 249/214 |
| 4,561,134 | A * | 12/1985 | Mathews et al. | 4/496 |
| 4,936,540 | A * | 6/1990 | Boeshart | 249/216 |
| 6,971,125 | B2 * | 12/2005 | Mattson, Jr. | A61H 33/0087 210/167.11 |
| 2010/0320751 | A1 * | 12/2010 | Verdenik | 285/139.1 |

FOREIGN PATENT DOCUMENTS

WO WO 2007053645 A2 * 5/2007

OTHER PUBLICATIONS

Hayward Pool Products, 2013 Buyer's Guide & Parts Price List, pp. 98, 246. Fitting believed to be on sale more than one year prior to date applicant's patent application was filed.
Pentair Aquatic Systems, 2013 Product Catalog, pp. 68, 69, 242. Fitting believed to be on sale more than one year prior to date applicant's patent application was filed.
Waterway Plastics, 2009 Waterway Pood and Spa Products Buyer's Guide, pp. 120, 152.
Astral Pool USA, 2010-2011 Commercial and Residential Pool Equipment Catalog, pp. 79-81.
CMP (Custom Molded Products), 2013 Pool Catalog, pp. 78-79. Fitting believed to be on sale more than one year prior to date applicant's patent application was filed.
STA-RITE Pool/Spa Group, 2005 Pool Products Catalog, pp. 108, 239.
Jacuzzi Bros., 2000 Pool and Spa Equipment Catalog, p. 45.
Astral Pool, 2007 Multiflow Return Inlets Model Panel Pools 15cm, Code 33091, Rev. 00, (Sold primarily in the United Kingdom).
Frank Wall Enterprises, LLC, 2012 Aqua Forms catalog, p. 13. Shows existing method of installing return inlets believed to be in use more than one prior to date applicant's patent application was filed.

* cited by examiner

*Primary Examiner* — Huyen Le
*Assistant Examiner* — Christine Skubinna
(74) *Attorney, Agent, or Firm* — Erickson Kernell IP, LLC

(57) ABSTRACT

A fitting for a poured concrete pool wall comprising a tubular stem with one or more grooves extending therethrough for connecting the fitting to a wall tie used with a pool wall form assembly such that the fitting may be secured on the wall tie during pouring of the pool wall. The fitting spans the gap between inner and outer forms. The fitting may include a square face plate mounting flange with upper and lower edges that are oriented horizontally through the coupling of the wall tie in the fitting grooves. A square face plate may be registered with and then secured to the mounting flange such that the upper and lower edges of the face plate also extend horizontally. The fitting forms a conduit through the pool wall for connection to a water return system or to serve as a niche for securing a pool light therein.

10 Claims, 6 Drawing Sheets

SWIMMING POOL FILTER WATER RETURN FITTING

CROSS-REFERENCE TO RELATED APPLICATIONS

This application claims the benefit of provisional application Ser. No. 61/730,250, filed on Nov. 27, 2012, entitled SWIMMING POOL FILTER WATER RETURN FITTING.

BACKGROUND OF THE INVENTION

1. Field of the Invention

This invention relates to fittings installed in swimming pool walls for returning filtered water into the pool. More specifically, it relates to pool water return fittings installed in poured concrete swimming pool walls.

2. Background & Description of the Related Art

In-ground swimming pools can be built using a variety methods and materials. Pool walls can be made from fiberglass-reinforced plastic, vinyl-lined metal or wood frames, spray-applied gunite, poured concrete and concrete lined with a polymeric sheet material. The present invention is intended for use in swimming pool walls created by pouring a wet concrete mixture into a mold consisting of interlocking wall forms held in place with wall ties including such concrete walls lined with a liner.

Typically, poured concrete swimming pool walls are made by building a mold for the walls utilizing engineered modular forms. The forms are interconnected with one another to outline the sides of the pool wall. The wall is created by filling the space between the modular forms with wet concrete and allowing the concrete to cure. The forms are then removed and the cured concrete wall remains. The forms are modular or sectional in nature which means that they are interconnected as necessary to form a continuous mold for the poured wall. Each section of the wall is molded by an opposing pair of forms. An inner form molds the inside face of the wall and an outer form molds the outside face of the wall. The paired forms are positioned in an opposing and spaced apart configuration, the space between the forms being the desired wall thickness.

The forms are held at the desired wall thickness by wall ties spanning the space between the forms and connecting the inner form to its paired outer form. The wall ties typically connect to the forms by engaging pins projecting horizontally from the vertical sides of each form. Each tie engages a pin on an inner form and a corresponding pin on the paired outer form. The wall ties prevent the paired forms from moving closer together or further apart when concrete is poured into the space between the forms. Typically, a wall tie remains embedded in the concrete wall when the forms are removed and the part of the tie projecting out of the wall is removed so the end of the tie is generally flush with the face of the wall.

Many swimming pools utilize a filtration system for keeping the pool clean and free of debris. The filtration system generally takes the form of a pumped system that removes water from the pool and draws or pushes the water through a filter. The filtered water is returned to the pool through the filtered water return system. The return system piping connects to a return fitting installed in the pool wall which allows the return water to flow back into the pool.

A pool water return fitting typically comprises a flanged tubular body with a round face plate that connects the pool return water system to the swimming pool. The flange of the fitting installs nearly flush with the interior face of the pool wall, and the face plate attaches to the flange with the pool liner and a gasket located between the face plate and flange. A problem with currently available pool water return fittings is that they are not long enough to span the width of a poured concrete wall. Spanning the width of the wall is necessary to ensure the fitting can be connected to the return system piping on the back of the pool wall after the concrete has cured and the forms have been removed. Because currently available fittings are not long enough to span the width of a poured concrete wall, a makeshift extension must be created and attached to the fitting if such a wall is desired. The pieces in a typical return fitting extension are a male adapter screwed into the return fitting, a short section of pipe glued to the male adapter, and a slip coupling glued to the short section of pipe. These extensions are often made on site with leftover fittings and piping, and because each extension is made on an as-needed basis, they lack uniformity in size and quality.

When a fitting and extension assembly is mounted in a poured concrete form system it can only be secured from one end. This is because the fitting is the only part of the assembly designed to receive a threaded fastener which is the common method for mounting the apparatus prior to pouring the concrete. Typically, the return fitting is screwed to the inner form which leaves the extension unsupported and cantilevered out from the form, making it susceptible to damage from poured concrete. Pouring concrete on top of the cantilevered extension can cause it to become vertically or horizontally angled and misaligned. Also, because the return fitting must be screwed to the inner form, mounting holes must be drilled in the form which results in permanent damage to the form.

If the extension ends up being slightly shorter than the distance between the forms, concrete may surround the unsupported end of the extension and incase it inside the wall, or concrete could leak into the extension's interior. Conversely, if the extension is too long, it can break when squeezed between the forms. Even if the extension is presumed to be the proper length, duct tape is usually wrapped around the end of the extension as a precautionary measure to prevent concrete from inadvertently leaking into the assembly.

It is undesirable to use custom-made return fitting extensions every time a poured concrete wall is constructed. Creating extensions adds time and expense to a swimming pool construction project. The extensions also face potential damage from the concrete pouring process. What is needed in the swimming pool industry is a return fitting designed for installation in poured concrete walls.

SUMMARY OF THE INVENTION

The present invention is directed to a fitting for a pool wall which is adapted to be secured to and supported on a wall tie used with a wall form assembly for forming a poured wall for the swimming pool. The fitting includes a tubular stem or body with a bore extending therethrough. A wall tie is inserted through the bore of the fitting and into or through one or more grooves associated with the fitting to prevent rotation of the fitting relative to the wall tie with the wall tie supporting the fitting to prevent it from being dislodged vertically or horizontally when concrete is poured in to the wall form assembly and around the fitting. In a preferred embodiment, a pair of grooves are formed in the fitting, projecting radially outward from the bore in planar alignment. Upper and lower edges of the wall tie are then received in the grooves either directly or indirectly through one or more extenders secured on the wall tie.

The fitting is sized to span the gap between inner and outer forms of the wall form assembly such that once the concrete poured therebetween sets and the forms are removed the fitting provides a conduit through the poured concrete wall. The fitting may include a glue socket or hub formed in the outer end thereof so that the fitting may be coupled to a pipe forming part of the water return system for the pool so that water may be directed out the fitting and into the pool. In such an application, an externally threaded flow directing nozzle assembly is coupled to an internal thread formed in the tubular stem near the inner end thereof. The fitting may also serve as a niche for a pool light assembly, with the light threaded into the fitting and wiring for the light assembly extending through the outer open end of the fitting and through the pool wall for coupling with electrical leads on the outside of the pool wall.

A face plate mounting flange may be formed on the tubular stem to facilitate connection of a face plate to the fitting and to form a water tight seal between the fitting and a pool liner extending therearound by compressing the pool liner against an annular gasket positioned between the pool liner and the mounting flange. The tubular stem or body in combination with the mounting flange may be considered the fitting body. The face plate may be of any desired geometry, however, the fitting is particularly well adapted for use with a square mounting flange and a square face plate as mounting of the grooved fitting on a vertically oriented wall tie allows the fitting to be properly oriented with the upper and lower peripheral edges of the mounting flange and the face plate extending horizontally and the sides extending vertically. More specifically, the grooves in the fitting preferably lie in a plane extending parallel to two of the sides of the mounting flange and perpendicular to the remaining sides. A keyway formed on the back of the face plate aligns with a key formed on the mounting flange to orient the sides of the square face plate in parallel alignment with the sides of the mounting flange.

DETAILED DESCRIPTION OF THE PREFERRED EMBODIMENTS

Figure 1:
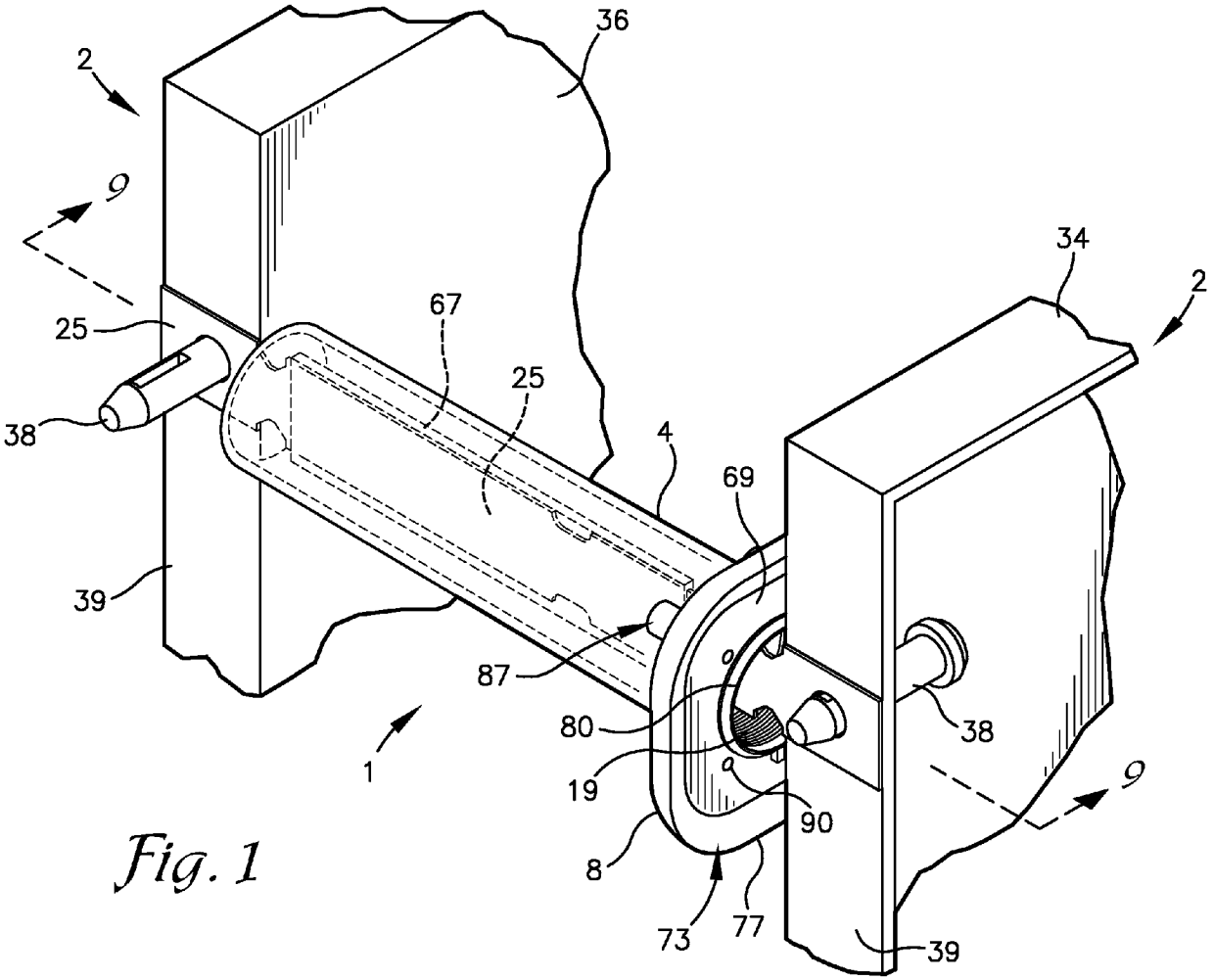
FIG. 1 is a perspective view showing a flanged tubular return fitting installed between two wall forms and secured in place by a wall tie mounted to the form connection pins for each form.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to the installed position of the item to which the reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, reference numeral 1 refers to a swimming pool return fitting or tubular fitting adapted for use with a wall form assembly 2 for forming a conduit through a poured concrete swimming pool wall 3. A primary use of the installed fitting 1 is to couple it to the return water system of the pool for directing filtered water back into the pool. The fitting 1 may also serve as a niche for receiving a pool light therein and it is foreseen that other uses for the fitting 1 may be developed.

Figure 2:
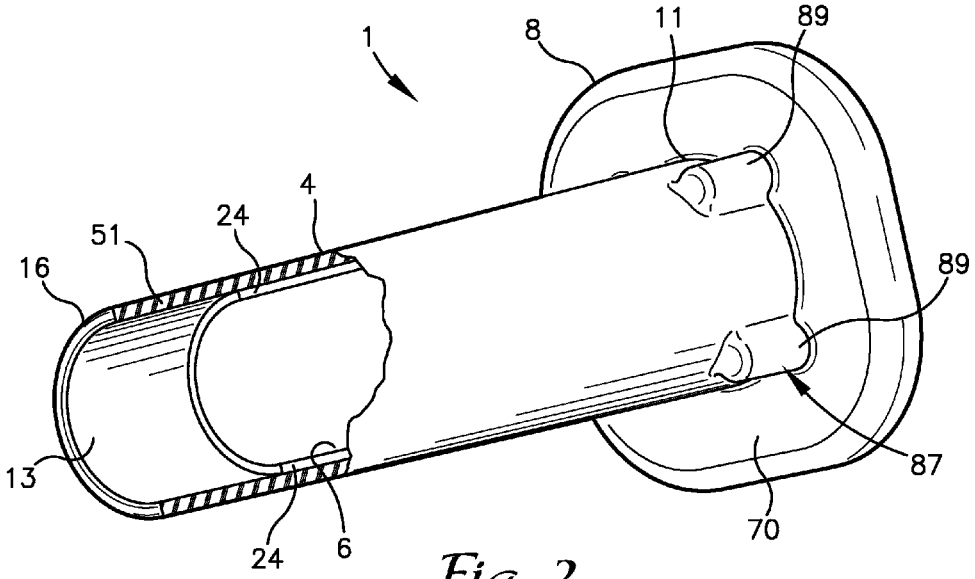
FIG. 2 is a rear perspective view of the return fitting with portions removed to show interior detail.
Figure 3:
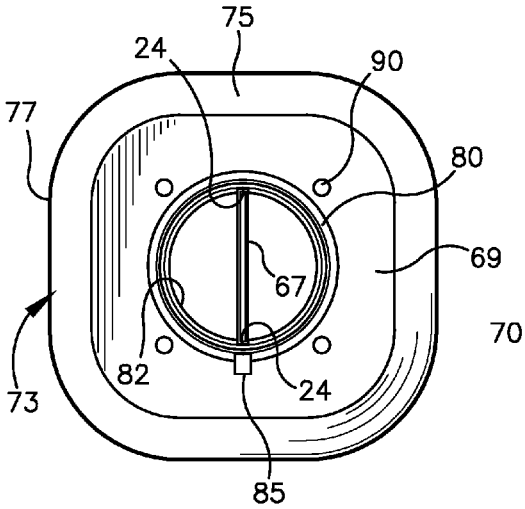
FIG. 3 is a front elevation view of the return fitting with a wall tie held in the return fitting by a wall tie sleeve surrounding the wall tie.
Figure 4:
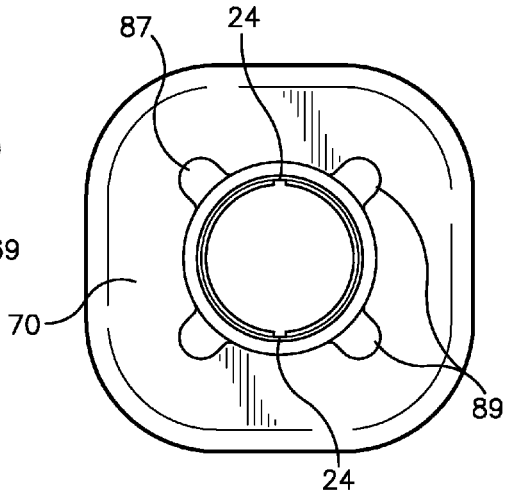
FIG. 4 is a rear elevation view of the return fitting with the wall tie and the wall tie sleeve removed from within the fitting.
Figure 5:
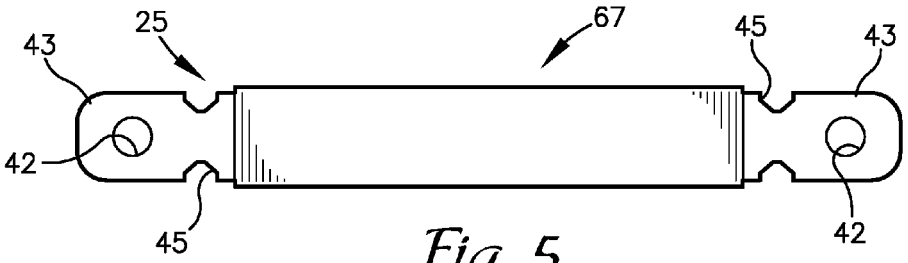
FIG. 5 is a side view showing a wall tie received in a wall tie sleeve.
Figures 10, 11:
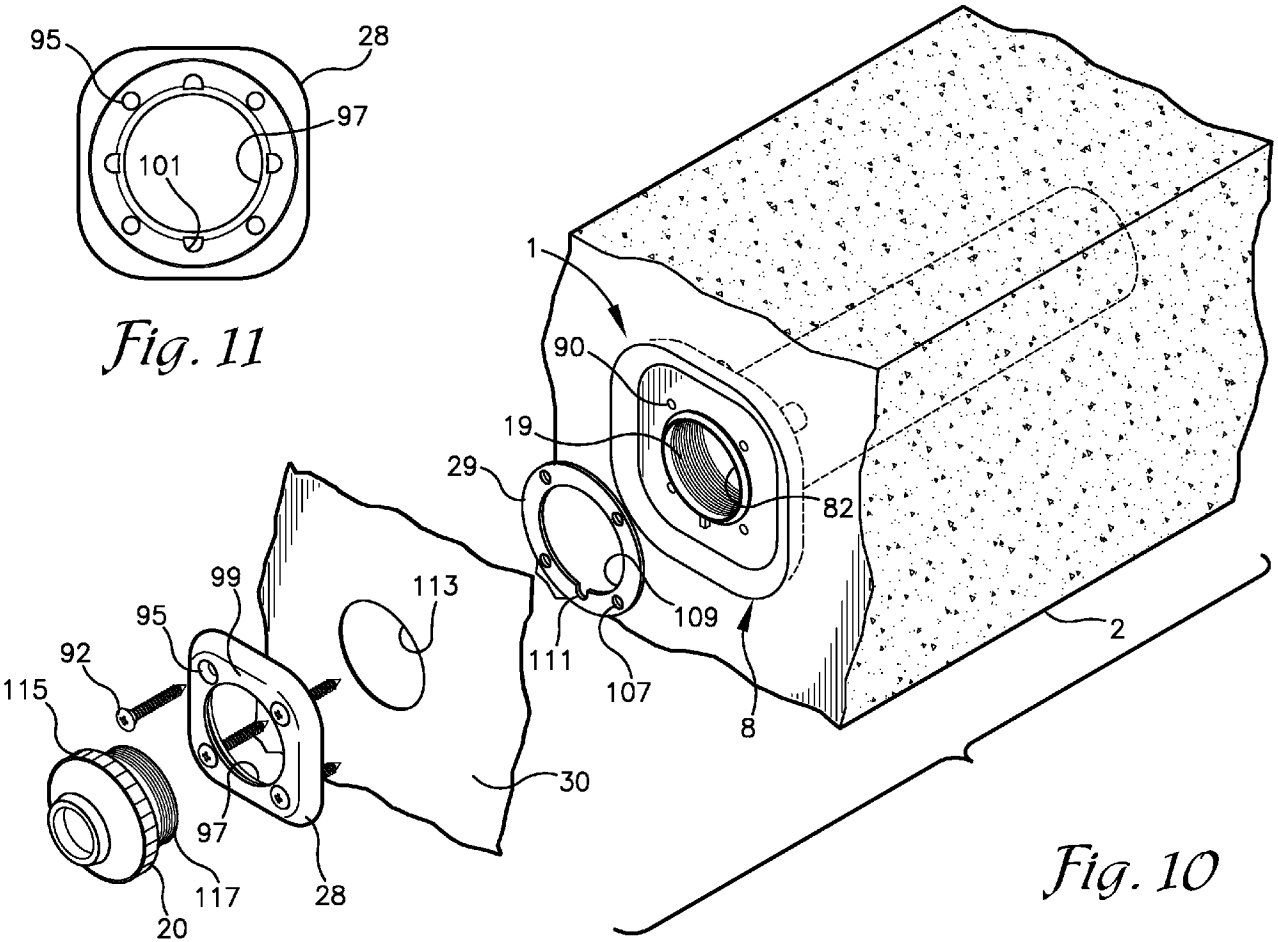
FIG. 10 is an exploded, front perspective view of the installed fitting with a directional nozzle assembly to be secured within the fitting and showing a square face plate for compressing a pool liner and a gasket against a flanged face of the fitting.
FIG. 11 is a rear elevation view of the square face plate.
Figure 12:
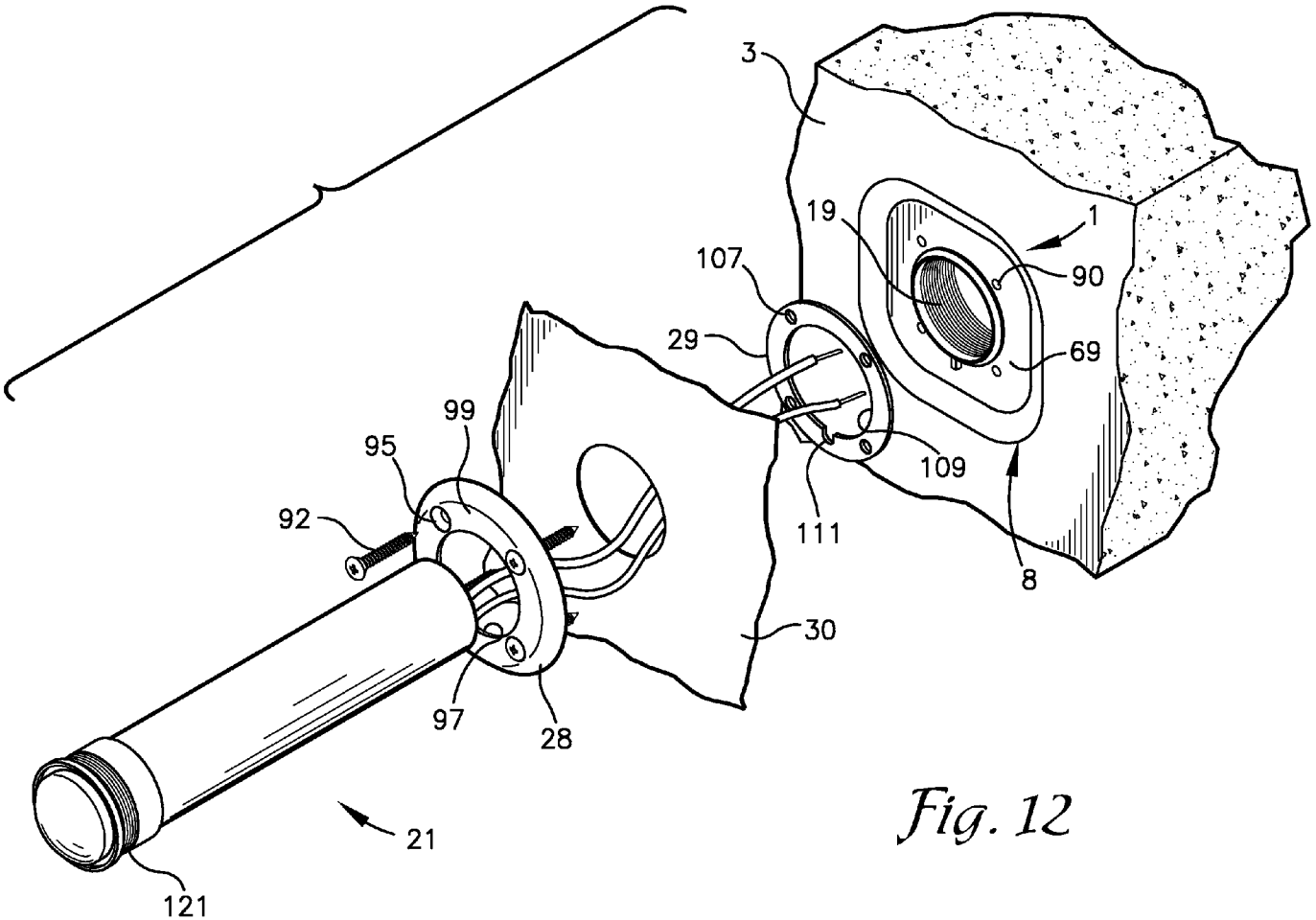
FIG. 12 is an exploded, front perspective view of the installed fitting being used as a light niche with a threaded light to be secured within the fitting and showing a round faceplate for compressing a pool liner and a gasket against a flanged face of the fitting.
Figure 13:
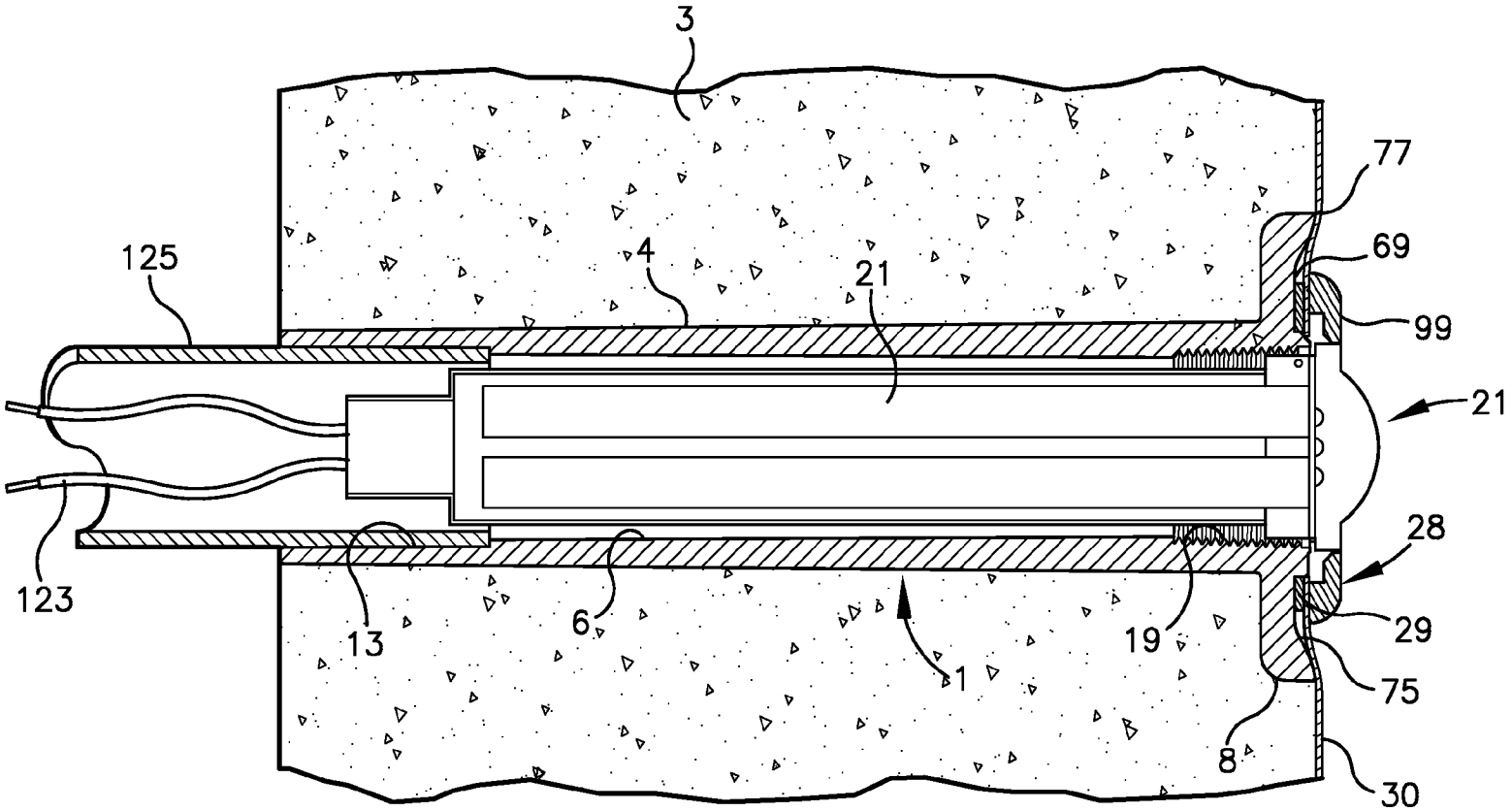
FIG. 13 is a cross-sectional view of the fitting installed in a finished wall and being used as a light niche with a threaded light fixture installed in the fitting.

The fitting 1 is preferably molded from plastic and includes a tubular stem or body 4 with a central bore 6 and a mounting flange 8 projecting radially outward from a first or inner end 11 of the tubular body 4. A glue hub or socket 13 is formed in the second or outer end 16 of the tubular body 4. The socket 13 is cylindrical and is sized for connection of a water return conduit therein. An internal thread 19 is formed in the tubular body 4 around bore 6 and extends inward from the inner end 11 approximately one to one and a half inches. As shown in FIG. 10, a nozzle assembly 20 may be secured within the fitting 1 and is threadingly coupled to the internal thread 19 when the fitting 1 is used as a water return conduit. Alternatively, a light assembly 21 may be secured within the fitting 1 and threadingly coupled to internal thread 19 when the fitting is used as a light niche as shown in FIGS. 12 and 13. As best seen in FIGS. 2-4, a pair of wall tie receiving slots or grooves 24 are formed in the interior surface of tubular body 4 along the central bore 6 in planar alignment or one hundred and eighty degrees apart to facilitate mounting or securement of the fitting 1 on a wall tie 25 as described in more detail hereafter.

The mounting flange 8 of fitting 1 is configured and shaped for securement of a face plate 28 against the flange 8 with a gasket 29 and a pool liner 30 compressed between the face plate 28 and the flange 8 to form a decorative water tight seal around the pool liner 30. The face plate 28 is generally annular and may be of a wide variety of geometries including square with rounded corners as shown in FIG. 10 or round as shown in FIG. 12.

As noted previously, fitting 1 is adapted for use with a poured concrete wall form assembly 2 for constructing swimming pool walls. The wall form assembly 2 generally comprises inner and outer forms 34 and 36 connected together in spaced apart relationship by a wall tie 25 mounted on pins 38 projecting through sidewalls 39 of the forms 34 and 36. Although only a single inner and outer form 34 and 36 are shown in the drawings, it is to be understood that multiple inner and outer forms 34 and 36 are positioned in end to end alignment and interconnected by pins 38 and wall ties 25 to create the pool wall form assembly 2.

The fitting 1 is adapted for use with standard sized wall form ties or wall ties 25 which are formed as relatively thin, rectangular bands of metal having mounting holes 42 extending through end segments 43 of each wall tie 25. Most wall ties have notches 45 at various positions along their longitudinal edge to facilitate shearing off segments 43 of the tie 25 at the notched location after removal of the forms 34 and 36 such that the resulting ends of the tie 25 extend flush with the finished pool wall. Fitting 1 can be used with a wide variety of wall ties 25 including ties 25 with or without notches 45. The term wall tie as used herein refers to any type of thin band that is supported from a pin or other type of connector used with forms. The term includes conventional metal wall ties which are typically used with a poured concrete wall form system as well as any other thin band of any material that can support a fitting regardless of whether the band helps hold forms in place.

The stem 4 of the fitting 1 is sized to be supported on a wall tie 25 such that the tubular fitting 1 is supported on and retained in position by the wall tie 25 during pouring of the pool wall between inner and outer forms 34 and 36. The length of fitting 1 is preferably selected such that when fitting 1 is installed on a wall tie 25 secured to the inner and outer forms 34 and 36, the fitting 1 spans the gap between inner and outer forms 34 and 36. More specifically, when the fitting is supported on the wall tie 25, the second or outer end 16 of stem 4 preferably contacts an inner surface of the outer form 36 and the outermost edge of the flange 8 of fitting 1 preferably contacts and abuts against an inner surface of the inner form 34.

The fitting 1 is restrained from rotating relative to the wall tie 25 by extension of outer edges of the wall tie 25, directly or indirectly, within the opposed, tie receiving grooves 24 formed in the stem 4 of fitting 1. In the embodiment shown, the stem 4 is formed as a cylindrical wall 51. However, it is foreseen that wall 51 could also be tapered in a conical or frusto-conical fashion. It is also foreseen that the wall 51 could have a cross sectional shape other than circular or that the cross sectional shape might vary along its longitudinal axis. Stem 4 is preferably fabricated as a single continuous part.

As noted previously, the fitting 1 is preferably sized such that a light assembly 21 may be secured within the bore 6 extending through the fitting 1 and its stem 4. The diameter of commercially available light assemblies 21 may be wider than the height of a standard sized wall tie 25. The bore 6 of a fitting 1 sized to receive a conventionally sized pool light assembly 21, is therefore too wide for the edges of a standard sized wall tie 25 to extend into the tie receiving grooves 24 formed in such a fitting 1. To accommodate this discrepancy in sizes, each wall tie 25 is inserted into a wall tie sleeve 54 to increase the height of the tie 25 to be greater than the diameter of the fitting bore 6. The tie receiving grooves 24 are sized slightly wider than the sleeve 54 so that upper and lower ends of the sleeve 54 fit snugly within the tie receiving grooves 24. The sleeves 54 are preferably sized no longer than the length of the fitting 1 such that when the sleeves 54 are centered on the ties 25, both ends of the ties 25 and their corresponding mounting holes 42 remain uncovered to allow mounting of the ties 25 on form mounting pins 38.

The primary purpose of sleeves 54 is to serve as extenders that attach to ties 25 and span the distance between the tie and the valleys of the tie receiving grooves 24 when the ties 25 are inserted inside of fittings 1, thus allowing the ties 25 to indirectly engage the tie receiving grooves 24. It is foreseen that other types of extenders may be used to hold tie 25 securely in the tie receiving grooves 24. It is also foreseen that a larger than standard size wall tie 25 could be used to engage the grooves 24 directly or the tubular stem 4 could be reduced in size so that a standard size wall tie 25 would engage the grooves 24 directly. However, because fitting 1 is sized to accept certain pool accessories and equipment, it is believed that the best method for engaging grooves 24 with ties 25 is by using the sleeves 25 or other extenders as discussed herein.

It is understood that a groove 24 may or may not extend the length of the interior surface of tubular body 4 depending on the configuration of the interior of the tubular body. For example, if tubular body 4 includes a socket 13, groove 24 may not extend through the socketed portion of tubular body 4. Conversely, if tubular body 4 does not include a socket, groove 24 may extend the entire length of the tubular body. It is also foreseen that one or more protruding discontinuous structures (not shown) such as rings or pedestal like supports may be formed in or fused to the interior of tubular body 4, and these discontinuous structures may have grooves 24 formed therein. Regardless of the location of the grooves 24, it is understood that the grooves will be adapted to permit sliding of the wall tie 25 relative to the tubular body 4.

Figure 6:
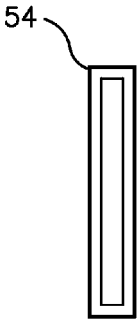
FIG. 6 is an end view of the wall tie sleeve.
Figure 7:
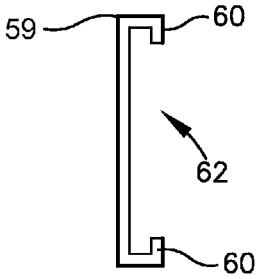
FIG. 7 is an end view of alternate embodiment of the wall tie sleeve in the form of a C-shaped channel.
Figure 8:
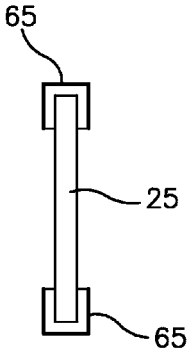
FIG. 8 is a view of a wall tie having wall tie extenders in the form of U-shaped strips mounted on upper and lower edges of the wall tie.
Figure 9:
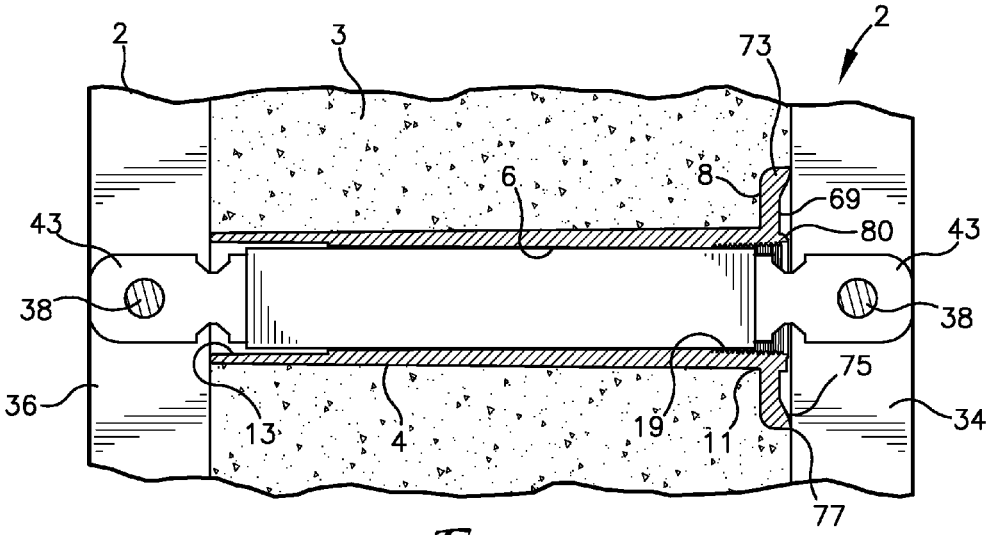
FIG. 9 is a cross-sectional view taken generally along line 9-9 of FIG. 1 after concrete has been poured around the fitting.

As shown in FIG. 6, sleeves 54 may be formed as a relatively flat extruded rectangular sleeve into which wall tie 25 is inserted. The sleeves 54 may be formed from plastic, metal, paper or other suitable material. It is foreseen that instead of completely wrapping around tie 25, sleeves 54 could be formed with a cross sectional shape similar to a C-channel 59 as shown in FIG. 7. The C-channel 59 includes relatively short legs 60 on one side with a gap 62 extending therebetween and is formed from a flexible material such as plastic such that the C-channel 59 can generally be snapped over a tie 25 instead of having to slide the C-channel 59 onto a tie 25. It is also foreseen that slotted strips or U-shaped end caps 65, as shown in FIG. 8, which are not connected together, could be mounted on and across each edge of the ties 25. The sleeves 54, C-channels 59 and slotted strips 65 generally function as extenders to increase the height of the ties 25. The tie 25 inserted into sleeve 54, C-channel 59 or clips 65 may be referred to as a tie and extender assembly 67.

To secure one of the fittings 1 to a tie and extender assembly 67, the fitting is first oriented so that the tie receiving grooves 24 are aligned with the tie and extender assembly 67. The tie 25 and extender assembly 67 are then slid through the bore 6 of the fitting 1 until the distal end of the tie 25 extends out through the opposite end of the fitting 1 to expose the end segment 43 and mounting hole 42 at the opposite end of the wall tie 25 while leaving the end segment 43 and mounting hole 42 at the near end of the wall tie 25 exposed as well. The end segments 43 may then be secured on form mounting pins 38 with the fitting 1 extending between the inner surfaces of the inner and outer forms 34 and 36. The next set of inner and outer forms 34 and 36 are then secured on the mounting pins 38 such that the tie 25 is trapped between adjacent sets of inner and outer forms 34 and 36 respectively with the second end 16 of the fitting 1 abutting against the inner surface of the outer forms 36 and the flange 8 abutting against the inner surface of the inner forms 34. Concrete may then be poured and allowed to set between the forms 34 and 36 and around the fitting 1 without concrete entering the fitting bore 6.

Fittings 1 may be located at any point along the wall form assembly 2 where a wall tie 25 is used to hold forms 34 and 36 in place. After the concrete has set and the forms have been removed the wall tie assembly or tie and extender assembly 67 may be removed from fitting 1.

In the embodiment shown, mounting flange 8 is integrally formed with tubular stem 4 and extends outward from the stem 4 proximate the first end 11 thereof. Mounting flange 8 in combination with tubular stem 4 may be referred to as the fitting body. Mounting flange 8 includes a face 69 and a back 70. In the embodiment shown, flange 8 is square with rounded corners. A peripheral wall 73 extends around the flange 8 and projects forward from the face 69. A forward facing surface 75 of peripheral wall 73 angles slightly forward from the face 69 to a peripheral edge 77 of the flange 8. The peripheral edge 77 of the flange 8 is adapted to be positioned in engagement with and flush against an inner surface of the inner forms 34 of a wall form assembly 2 when installed.

A circumferential wall or ridge 80 encircles opening 82 where bore 6 extends through flange 8. Ridge 80 is shorter than and does not project forward from the face 69 of flange 8 as far as peripheral wall 73. A lateral protrusion or key 85 projects radially outward from the ridge 80 to aid in the alignment of a face plate 28 and gasket 29 against face 69.

Four fastener receivers 87 are integrally formed on fitting 1 projecting rearwardly from flange 8 in equally spaced relation around the stem 4 and outward from ridge 80. Each receiver 87 comprises a boss 89 with a fastener receiving hole 90 formed therein and opening through the face 69 of flange 8. The fastener receiving holes 90 are adapted to receive threaded fasteners or screws 92 used to attach the face plate 28 and gasket 29 to the mounting flange 8 with the pool liner 30 trapped therebetween.

Referring to FIG. 10, the face plate 28 shown is a generally square shaped plate with rounded corners similar to the shape of flange 8. The face plate 28 can be formed in other shapes including circular as shown in FIG. 11. Face plate 28 has four fastener holes 95 equally spaced around a centrally located circular opening 97. It is foreseen that opening 97 could be other shapes as well. Each mounting hole 121 is counter sunk to allow the head of the threaded fastener 92 to extend flush with or recess below an outer surface 99 of the face plate 28. One or more keyways or mating indentations 101 are formed in the back 103 of face plate 28 for mating engagement with the key 85 on the face 69 of mounting flange 8 to properly orient the face plate 28 relative to the mounting flange 8. Four keyways 101 are shown, spaced ninety degrees apart with opposed keyways 101 located in a plane extending perpendicular to two of the sides and parallel to the other two sides of the face plate 28.

The tie receiving grooves 24 in the fitting 1 generally lie in a plane extending parallel to two sides and perpendicular to the other two sides of the flange 8. Therefore, when the fitting 1 is mounted on a wall tie 25 extending vertically, the fitting will be set in the concrete with the upper and lower edges of flange 8 extending horizontally and the side edges of flange 8 extending vertically. The key 85 is preferably aligned with or lies in the same vertical plane that extends through the tie receiving grooves 24. The keyway 101 similarly lies in a plane that extends parallel to two of the straight sides of the face plate 28 such that when the face plate 28 is mounted against the flange 8 with the key 85 received in keyway 101 the upper and lower edges of face plate 28 extend horizontally and the sides of the face plate extend vertically. In addition, extension of the key 85 within keyway 101 brings the holes 95 in the face plate 28 into alignment with the fastener receiving holes 90 in flange 8. Face plate 28 is connected to mounting flange 8 by installing threaded fasteners 92 through fastener receiving holes 95 in face plate 28 aligned with fastener receiving holes 90 in the flange 8. As best seen in FIG. 3, adjacent pairs of the fastener receiving holes 90 are aligned in perpendicular or parallel alignment relative to the plane extending through the tie receiving grooves 24 in fitting 1.

Before attaching the face plates 28 to the fittings 1 set in the pool wall 3, gaskets 29 are attached to the face 69 of the flange 8 of each fitting 1 and the liner is installed over the pool wall 3, the gaskets 29 and fittings 1. A preferred gasket 29 may be formed from a closed cell foam with an adhesive back so that the gasket 29 will stay in place until the liner 30 and face plates 28 are installed. The gasket 29 has four fastener receiving holes 107 formed therethrough around a central aperture 109 which is sized slightly larger in diameter than the ridge 80 extending around opening 82. The fastener receiving holes 107 in gasket 29 are spaced similar to the spacing of fastener holes 95 in face plate 28 and fastener holes 90 in flange 8. A keyway or cutout 111 is formed in the gasket 28 for reception of the key 85 which then aligns fastener holes 107 in gasket 28 with the fastener holes 90 in flange 8. Once the gaskets 29 are attached to all of the fittings 1, the pool liner 30, which is formed from a polymeric material such as vinyl, is installed over the inner surface of the pool wall 3. A vacuum is pulled between the liner and pool wall 3 to pull the liner 30 tight against the pool wall 3. The location of the fittings 1, including keys 85, are visible through the liner 30 by the indentations made by the liner being drawn through opening 82 and into bore 6 of the fitting 1.

A face plate 28 is attached to each fitting 1 over the liner with the keyway 101 in the back of each face plate 28 registered with the key 85 on the face 69 of the fitting flange 8. Fasteners 92 driven through the face plate 28, liner 30 and gasket 29 and into the flange 8 drive the face plate 28 against the liner 30 and gasket 29, compressing the liner between the gasket 29 and face plate 28 to form a water tight seal therearound. Once the face plate 28 is attached, a utility knife or the like may be used to cut and remove the portion of the liner 30 extending over the opening 82 in fitting 1 by tracing around the edge of the opening 82 with the knife to form the hole 113 in liner 30.

If the fitting 1 is intended to be used as a return fitting, a length of pipe (not shown) forming part of the water return assembly is secured within the glue hub or socket 13 formed in the second end 16 of the fitting 1. The fitting 1 is preferably formed of a plastic which allows the return assembly pipe to be chemically welded or glued in place in socket 13 of fitting 1. A directional nozzle assembly 20 is installed in the bore 6 of fitting 1 through the opening 82 in flange 8. The nozzle assembly 20 may include a spherical flow directing nozzle mounted within a socket in the nozzle assembly 20 to allow selected orientation of the nozzle to direct water in a selected direction to project the return water out of the fitting 1 and into the pool. The base 115 of the nozzle assembly 20 shown includes an external thread 117 which can be threadingly coupled to the internal thread 19 formed in the first end 11 of bore 6 in fitting 1.

If fitting 1 is intended to operate as a light niche, an external thread 121 formed on an outer surface of the light assembly 21 may be threadingly mated with the internal thread 19 formed in tubular stem 4 proximate the first end 11 thereof to secure the light assembly 21 within the fitting 1. Wires 123 for electrical power may be routed to a low voltage power supply (not shown) through electrical conduit 125 secured at a first end within the glue hub or socket 13 of fitting 1. The electrical conduit is preferably formed from PVC or other solvent weldable plastic to allow the PVC electrical conduit 125 to be chemically welded or glued in place in socket 13.

It is foreseen that nozzle assembly 20, light assembly 21, and other pool equipment or accessories could be mounted in and attached to fitting 1 using fastening methods other than threads. Fitting 1 may be constructed from various materials however plastic is believed to be the preferred material because it is relatively corrosion resistant, durable, and economical. Threaded fasteners 92 would likely be made of a corrosion resistant metal such as stainless steel.

It is also foreseen that the grooves or slot for connecting the wall tie to the fitting could be formed in end caps inserted into the ends of the fitting prior to pouring the pool wall and then removed from the fitting with the wall tie once the concrete sets and the forms are removed. In addition, although the fitting is preferably molded as a single piece, sized to span the gap between inner and outer wall forms, it is foreseen that different contractors may prefer slightly different pool wall thicknesses and extenders inserted in the socket 13 in the outer end of the fitting could be used to accommodate larger gaps between the forms, although the integrally formed stem 4 and flange 8 of the fitting 1 would still span substantially the entire gap between the inner and outer forms.

Having thus described the invention, what is claimed as new and desired to be secured by this Patent is as follows:

1. A fitting adapted for installation in a poured concrete wall of a pool that is fabricated using a poured concrete form system held together using wall form ties comprising:
   - a tubular body;
   - a mounting flange projecting radially outward from said tubular body proximate a first end thereof;
   - a longitudinal groove formed in an inner surface of said tubular body and adapted to receive an edge of a wall form tie, said longitudinal groove adapted to permit sliding of the wall form tie relative to said tubular body;
   - an annular face plate securable to said mounting flange; and
   - a sleeve for at least partially surrounding the wall form tie or a cap for mounting on an edge of the wall form tie prior to the wall form tie being received in said longitudinal groove.

2. The fitting as in claim 1 wherein an end of said tubular body forms a socket for receiving a water return conduit.

3. The fitting as in claim 1 wherein said tubular body has an internal thread formed in and extending inward from the first end thereof a distance sufficient for threaded coupling of a threaded fixture therein.

4. The fitting as in claim 3 wherein said threaded fixture comprises a light.

5. The fitting as in claim 3 wherein said threaded fixture comprises a nozzle.

6. A pool fitting adapted for installation in a poured concrete pool wall that is fabricated using a poured concrete form system held together using wall ties comprising:
   - a fitting body having a tubular stem and a mounting flange integrally formed with and projecting radially outward proximate a first end of the tubular stem, said fitting body having a length sufficient to span the thickness of the concrete pool wall in which said fitting body is installed;
   - a pair of longitudinal grooves formed in an interior surface of said tubular stem in planar alignment; each longitudinal groove of said pair adapted to receive an edge of a wall tie, each longitudinal groove adapted to permit sliding of the wall tie relative to said tubular stem; and
   - a face plate securable to said mounting flange, said face plate and said mounting flange adapted to receive a pool liner therebetween;
   - wherein the mounting flange includes at least two parallel sides and the pair of longitudinal grooves lie in a plane extending parallel to or perpendicular to the at least two parallel sides of the mounting flange; and
   - said pool fitting in combination with:
   - a sleeve sized to surround at least the edges of the wall tie and wherein each longitudinal groove of said pair is adapted to receive a portion of said sleeve surrounding one of the edges of the wall tie; or
   - end caps secured over the edges of the wall tie and wherein each longitudinal groove of said pair is adapted to receive one of the end caps secured over one of the edges of the wall tie.

7. The pool fitting as in claim 6 wherein an end of said tubular stem forms a socket for receiving a water return conduit.

8. The pool fitting as in claim 6 wherein said tubular stem has an internal thread formed therein and extending inward from the first end of the tubular stem.

9. The pool fitting as in claim 8 in combination with a nozzle threadingly couplable to said tubular stem.

10. The pool fitting as in claim 8 in combination with a light threadingly couplable to said tubular stem.

* * * * *